US008703270B2

(12) United States Patent
Hümmerich

(10) Patent No.: US 8,703,270 B2
(45) Date of Patent: Apr. 22, 2014

(54) NAPKIN

(75) Inventor: Lothar Hümmerich, Hanschbach (DE)

(73) Assignee: Mank GmbH, Dernbach Bei Dierdorf (DE)

( * ) Notice: Subject to any disclaimer, the term of this patent is extended or adjusted under 35 U.S.C. 154(b) by 508 days.

(21) Appl. No.: 12/669,559

(22) PCT Filed: Jun. 14, 2008

(86) PCT No.: PCT/DE2008/001026

§ 371 (c)(1),
(2), (4) Date: Feb. 8, 2010

(87) PCT Pub. No.: WO2009/010031

PCT Pub. Date: Jan. 22, 2009

(65) Prior Publication Data

US 2010/0203285 A1 Aug. 12, 2010

(30) Foreign Application Priority Data

Jul. 19, 2007 (DE) ..... 10 2007 033 572

(51) Int. Cl.

| | |
|---|---|
| ***B32B 3/04*** | (2006.01) |
| ***B32B 3/24*** | (2006.01) |
| ***A47G 21/00*** | (2006.01) |
| ***A47G 23/00*** | (2006.01) |
| *B31D 1/04* | (2006.01) |

(52) U.S. Cl.

USPC ..... 428/136; 428/121; 428/130; 428/134; 428/212; 206/494; 206/553; D7/637

(58) Field of Classification Search

USPC ..... 206/476, 426, 553; D7/637

See application file for complete search history.

(56) References Cited

U.S. PATENT DOCUMENTS

| | | | | | |
|---|---|---|---|---|---|
| 847,254 | A | * | 3/1907 | Jackson | 206/553 |
| 923,182 | A | * | 6/1909 | Joachim | 229/75 |
| 1,384,515 | A | * | 7/1921 | Conradson et al. | 162/114 |
| 1,407,792 | A | * | 2/1922 | Hatzung | 206/373 |
| 1,727,064 | A | * | 9/1929 | Joseph | 206/494 |
| 2,025,963 | A | * | 12/1935 | Voelcker | 215/394 |
| 2,218,892 | A | * | 10/1940 | Ratzlaff | 206/553 |
| 2,763,867 | A | * | 9/1956 | Chagnon | 2/49.1 |
| 2,771,188 | A | * | 11/1956 | Coulter | 206/553 |

(Continued)

FOREIGN PATENT DOCUMENTS

| | | | | |
|---|---|---|---|---|
| CH | 609547 A | * | 3/1979 | A47G 11/00 |
| DE | 202005005882 | | 8/2006 | |
| DE | 202006017180 U1 | * | 2/2007 | |

OTHER PUBLICATIONS

English Abstract for CH 609547 A, Mar. 1979.*

(Continued)

*Primary Examiner* — Aaron Austin
*Assistant Examiner* — Jeff Vonch
(74) *Attorney, Agent, or Firm* — Jennifer S. Stachniak; Robert W. Becker

(57) ABSTRACT

A napkin having a basic quadratic shape. Two or three slits are provided that are disposed parallel to one another. The slits are spaced from at least one outer edge of the napkin, and each slit has a length configured to receive at least a portion of a piece of cutlery or an eating utensil therethrough.

6 Claims, 4 Drawing Sheets

(56) References Cited

U.S. PATENT DOCUMENTS

| | | | | | |
|---|---|---|---|---|---|
| D209,849 | S | * | 1/1968 | Farrell | D7/632 |
| 3,376,974 | A | * | 4/1968 | Hilliard | 206/217 |
| 3,833,937 | A | * | 9/1974 | Taylor | 2/46 |
| 3,939,976 | A | * | 2/1976 | Vanlseghem, Jr. | 206/390 |
| 3,978,553 | A | * | 9/1976 | Honig | 24/7 |
| 4,800,108 | A | * | 1/1989 | Swartz | 428/43 |
| 4,993,845 | A | * | 2/1991 | Faltynek | 383/40 |
| 5,011,017 | A | * | 4/1991 | Giesen | 206/494 |
| 5,279,456 | A | * | 1/1994 | Bernstein | 229/87.08 |
| 5,469,688 | A | * | 11/1995 | Dunbar et al. | 53/419 |
| 2005/0028238 | A1 | * | 2/2005 | Tobin et al. | 2/11 |
| 2006/0019060 | A1 | * | 1/2006 | Heldibridle et al. | 428/102 |
| 2008/0110787 | A1 | | 5/2008 | Hummerich | |
| 2010/0044271 | A1 | * | 2/2010 | McMillan | 206/553 |
| 2010/0212266 | A1 | * | 8/2010 | Elsaesser et al. | 53/455 |
| 2010/0307955 | A1 | * | 12/2010 | McMillan | 206/553 |

OTHER PUBLICATIONS

Machine Translation of DE 202006017180 U1, Feb. 2007.*

* cited by examiner

NAPKIN

BACKGROUND OF THE INVENTION

The instant application should be granted the priority dates of Jul. 19, 2007, the filing date of the corresponding German patent application DE 10 2007 033 572.7, as well as Jun. 14, 2008, the filing date of the International patent application PCT/DE2008/001026.

The present invention relates to a napkin having a basic quadratic shape.

DE 20 2006 017 180 U1 discloses a sheet of paper that is provided with a multiple fold in order to form a closed pocket, especially for accommodating cutlery. A field of the sheet of paper that forms an outer side of the pocket has a punched or stamped out portion that serves as a slide-in part.

DE 20 2005 005 882 U1 furthermore shows a napkin that is produced from cellulose, paper or a similar material, whereby the single-ply general form is brought into a multi-ply form for use by fold lines that cross one another. As a result of the multiple folding, an insertion pocket is formed that is open toward one narrow side, and that serves, for example, for receiving pieces of cutlery, information material, or the like, whereby the opening edge of the insertion pocket is parallel to and at a distance from the adjacent napkin edge. For the formation of the insertion pocket, a first fold portion is folded about a first fold line that is parallel to and opposite from the napkin edge. A further fold extends centrally and transverse to the first fold line, and thereafter an additional fold is undertaken about a then existing central second fold line in order to achieve the form of use that is provided with the insertion pocket.

It is an object of the present invention to provide a napkin of the aforementioned general type that with straightforward means is configured for holding pieces of cutlery.

SUMMARY OF THE INVENTION

Pursuant to the invention, this object is realized by a slit that is spaced from at least one outer edge and that has a length for inserting at least a portion of a piece of cutlery or an eating utensil therethrough.

The piece of cutlery is inserted through the slit in such a way, and the napkin is placed in such a way, that that portion of the piece of cutlery that comes into contact with food rests hygienically on the napkin. In this napkin, a handle or grasping portion of the piece of cutlery is at least partially covered by the napkin. Service personnel or wait staff can stockpile such napkins that are provided with cutlery. The napkin is weighted by the cutlery, and when covering a table the wait staff can grasp the cutlery via the napkin. After a user has removed the cutlery from the napkin, the napkin can be used for appropriate protection and cleaning purposes during and after eating, in which connection the slit has no disruptive effect. The paper of the napkin can, for example, be a so-called Airlaid non-woven material.

Pursuant to one specific embodiment, two or three slits are provided that are disposed parallel to one another. The pieces of cutlery are quasi threaded through the slits, after which the pieces of cutlery are more or less covered by the napkin. Due to the plurality of slits, the pieces of cutlery are optically aligned or oriented in a pleasing manner relative to the napkin, which is reliably connected with the pieces of cutlery.

In order to provide as large a support or contact surface for the pieces of cutlery as possible, with a basic rectangular shape the slits extend parallel to one narrow side and at a distance to the two long sides.

One slit is expediently longer than the other slits. The longer slit is advantageous for receiving a shaped portion of a fork or spoon, whereby all of the slits have such a length that at least two pieces of cutlery can be inserted next to one another. A longer slit that extends nearly to the long sides can be provided not only in the upper region but also in the central region if the napkin has several slits.

Pursuant to a further development, the slit is knife edge like. Consequently, no material is cut out of the napkin, as is known, for example, from the prior art. Rather, the entire surface of the napkin is available for the definitive or designed covering and cleaning during and after eating.

A square sheet is advantageously folded several times to form a basic rectangular shape. The square sheet can correspond in size to that of a standard napkin, and can have, for example, a side length of about 400 mm. The multiple folding results in a type of pocket, and a free end of the piece of cutlery inserted into the slit is supported within the pocket, while another end of the piece of cutlery is exposed. In its development, the square sheet expediently has a first fold line that is disposed centrally as well as parallel to two of the oppositely disposed outer edges of the sheet; fold lines having respectively opposing folding directions extend perpendicular to the first fold line, and equidistantly relative to one another, as a result of which the sheet, in a four times two matrix, is divided into fields of the same size in the basic rectangular shape.

To achieve an optically pleasing configuration of the napkin that is provided with pieces of cutlery, at least one corner of a square form, which results from a double folding of the square sheet, is folded. Two corners on one side could also be folded over, so that a triangular envelope results that is folded over the cutlery. The slits are preferably disposed either in a field disposed at an edge or in a middle field. Pursuant to a further development, with an arrangement of the slits in a middle field, an outer rectangle covers at least portions of the basic rectangular shape having the slits. The pieces of cutlery are thereafter disposed in an envelope, and are largely protected from becoming dirty.

So that the pieces of cutlery rest upon the napkin such that they are protected from getting dirty, the upper slit is disposed in an upper fourth of the field. The lower slit is preferably disposed in a lower eighth of the field.

It is to be understood that the previously mentioned and subsequently still to be described features can be used not only in the respectively indicated combinations but also in other combinations. The scope of the invention is defined only by the claims.

BRIEF DESCRIPTION OF THE DRAWINGS

The invention will be described in greater detail in the following with the aid of several specific embodiments in conjunction with the pertaining drawings, in which.

DESCRIPTION OF SPECIFIC EMBODIMENTS

Figure 1:
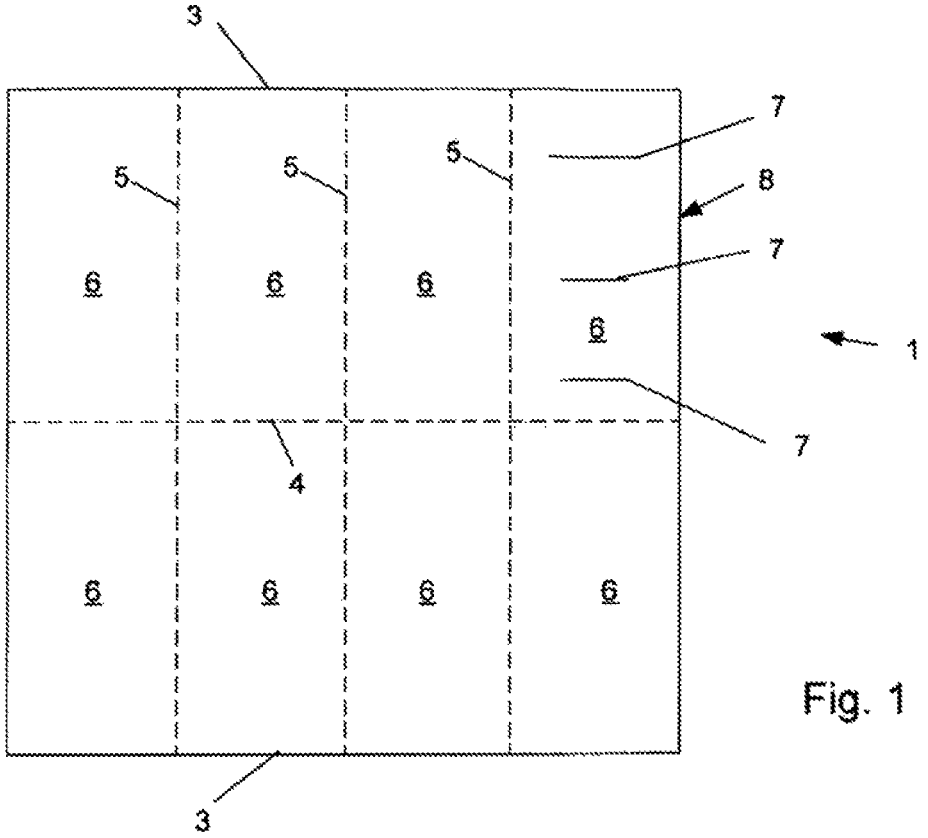
FIG. 1: shows a development of a first exemplary embodiment of an inventive napkin.

Pursuant to FIG. 1, the napkin is comprised of a square sheet 1 of paper that is folded multiple times to form a basic rectangular shape 2. For this purpose, in its development the sheet 1 is provided centrally as well as parallel to two of its opposite outer edges 3 with a first fold line 4; fold lines 5 having respectively opposing folding directions extend perpendicular to the first fold line, and equidistantly relative to one another, as a result of which the sheet, in a four times two matrix, is divided into fields 6 of the same size in the basic rectangular shape 2.

The field 6 in the upper right hand position has three parallel and spaced-apart slits 7 that extend perpendicular to the long edges 8 of the basic shape 2 and hence of the corresponding field 6. The upper slit 7, which is somewhat longer than the two slits 7 disposed below it, is, as viewed in the longitudinal direction of the field 6, disposed in an upper fourth of the field 6; the middle slit 7 is disposed below the center, and the lower slit 7 is disposed in a lower eighth of the field 6. Pieces of cutlery or eating utensils are inserted into the slits 7, and in particular in such a way that the handle parts are inserted in the uppermost slit 7, emerge from the central slit 7, and are subsequently introduced into the lowermost slit 7. The ends of the handle parts of the pieces of cutlery thus abut at direction reversal of the sheet 1 formed by the one fold line 4.

Figure 2:
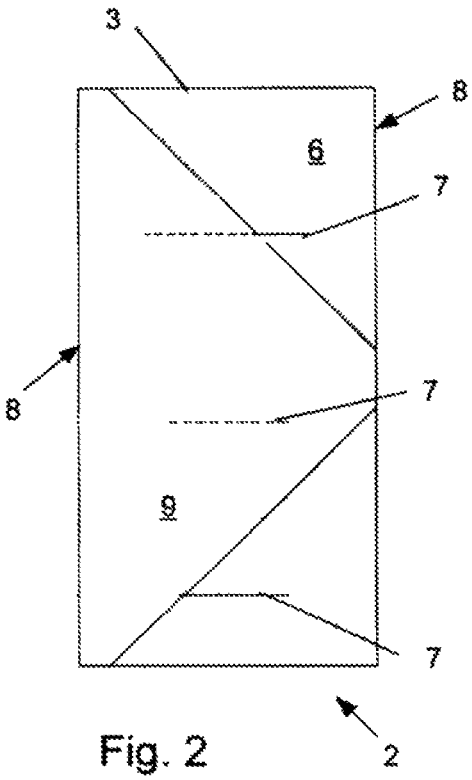
FIG. 2: is a plan view onto the napkin of FIG. 1 in the folded state.
Figure 3:
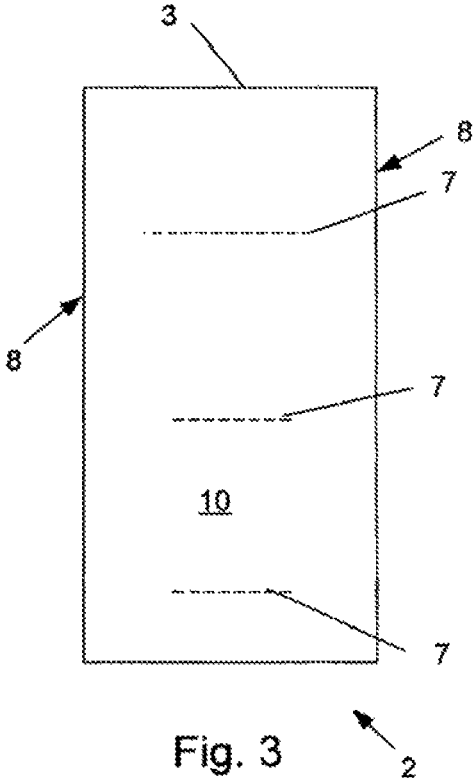
FIG. 3: is a plan view onto the napkin of FIG. 1 pursuant to an alternative folding.

Pursuant to FIG. 2, after the sheet 1 is folded twice, each time centrally, to form a square, there is effected a folding of two corners in that region opposite the field 6 having the slits 7. Consequently, a triangular envelope 9 is formed that partially covers the field 6 having the slits 7, and hence also the pieces of cutlery accommodated next to one another in the slits 7. A rectangular envelope 10 pursuant to FIG. 3 is realized after the appropriate folding by the four middle fields 6, which in the basic shape 2 are disposed approximately congruently above one another. The rectangular envelope 10 completely covers the field 6 that is provided with the slits 7.

Figure 4:
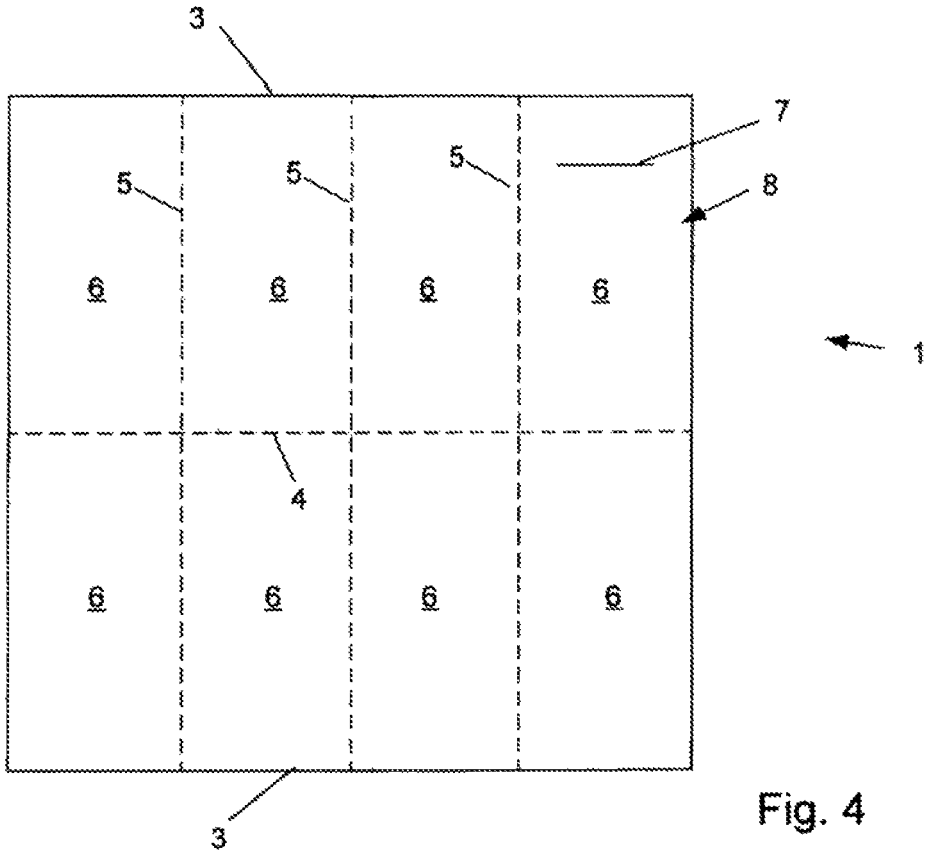
FIG. 4: shows a development of a second exemplary embodiment of the napkin.
Figure 5:
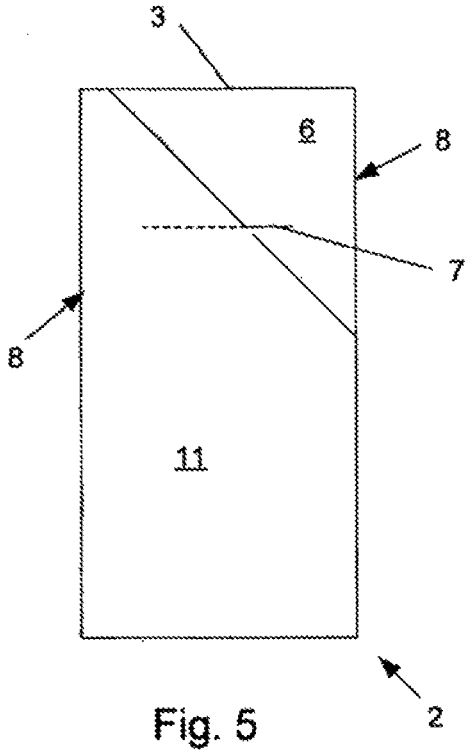
FIG. 5: is a plan view onto the napkin of FIG. 4 in the folded state.

Pursuant to FIG. 4, a knife edge-like slit 7 is formed in the field 6 in the upper right hand position; the pieces of cutlery are inserted into this slit in such a way that the handle parts are covered by the field 6 and the portions that come into contact with food rest upon the field 6 of the napkin. The ends of the handle parts of the pieces of cutlery can rest on the direction reversal of the sheet 1 formed by the one fold line 4. An envelope 11 pursuant to FIG. 5, which partially does not cover the pieces of cutlery in those regions that come into contact with food, is achieved by the folding of an appropriate corner after the sheet 1 has been folded twice, each time centrally, to form a square.

Figure 6:
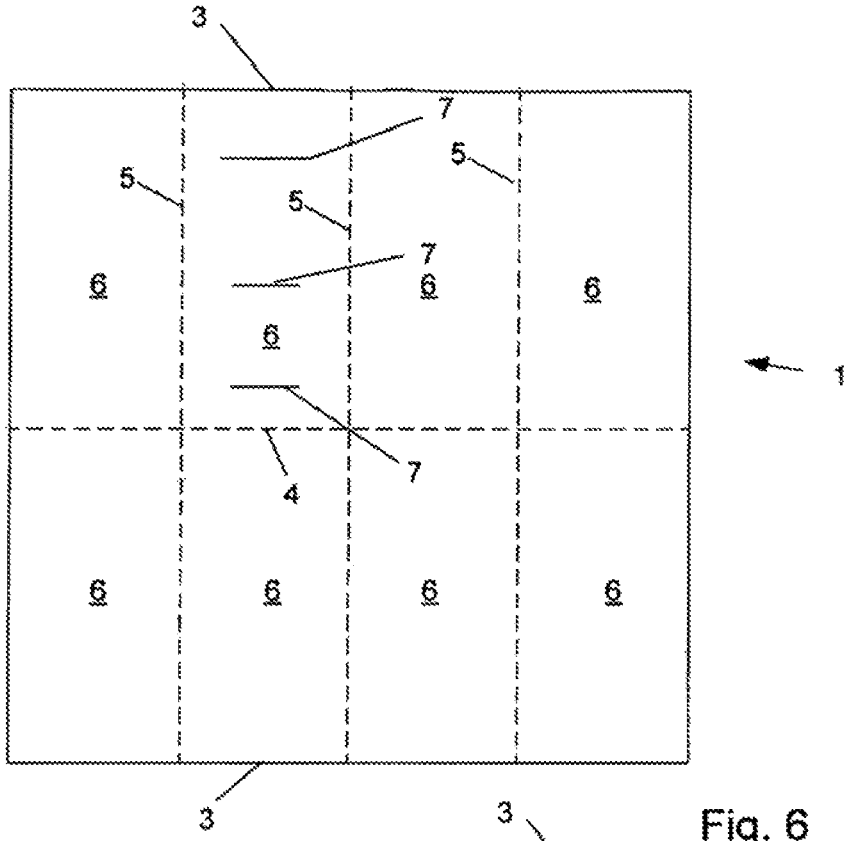
FIG. 6: shows a development of a third exemplary embodiment of the napkin.
Figure 7:
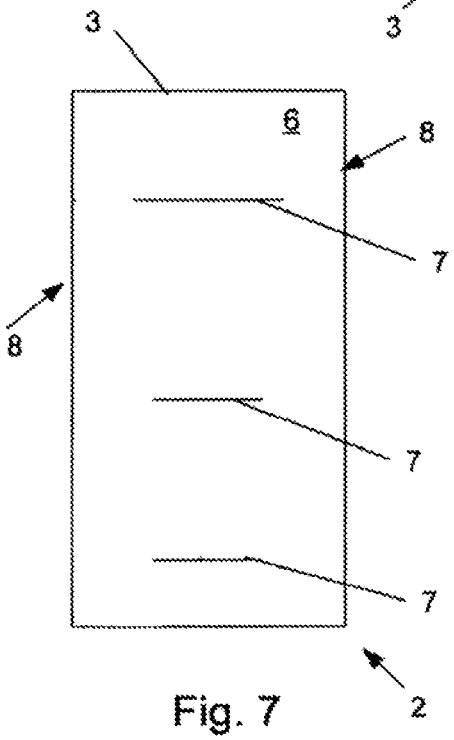
FIG. 7: is a plan view onto the napkin of FIG. 6 in the folded state.
Figure 8:
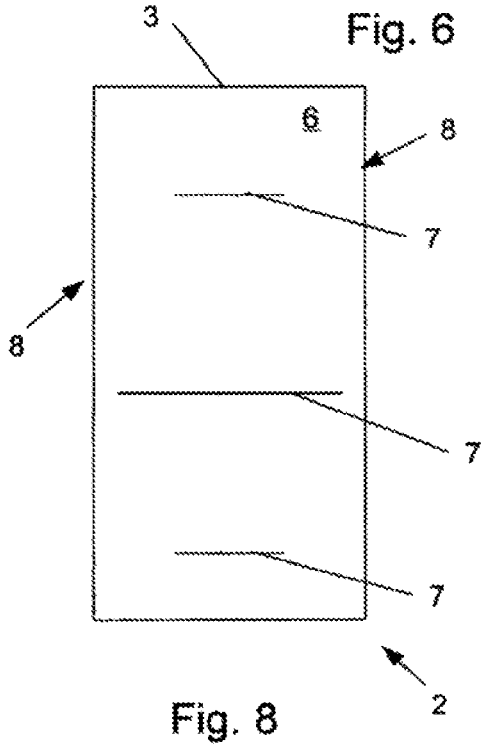
FIG. 8: is a plan view onto a fourth exemplary embodiment of the napkin in the folded state.
Figure 9:
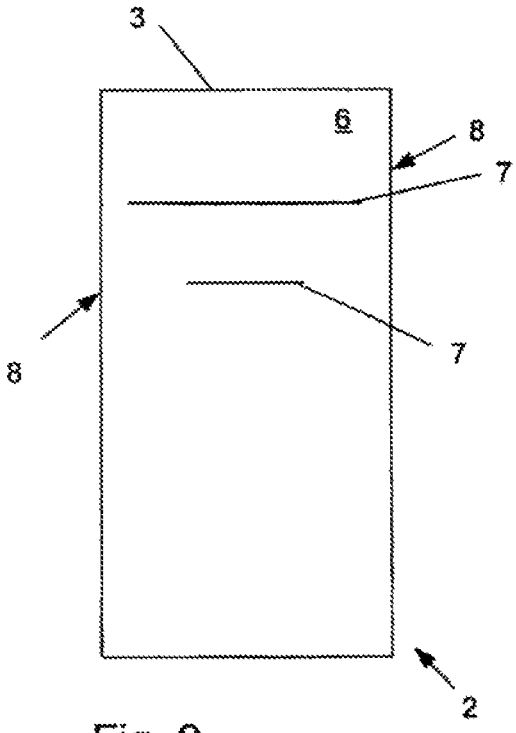
FIG. 9: is a plan view onto a fifth exemplary embodiment of the napkin in the folded state.

Pursuant to FIG. 6, the second upper field 6, as viewed from left to right, of the sheet 1 of the napkin is provided with three slits 7. Furthermore, pursuant to FIGS. 7 and 8, the sheet 1 is folded in such a way that the slits 7, in the basic rectangular shape 2 of the napkin in which it is placed on a table for use, are disposed on top, and as previously described the pieces of cutlery that are inserted into the slits 7 are largely visible. Pursuant to FIG. 8, the middle slit 7 is longer than the two other slits 7, which have the same length. In accordance with FIG. 9, only two slits 7 are cut into the upper third of the second upper field 6 of the sheet 1 of the napkin, whereby the upper slit 7 is longer than the lower slit 7.

Figure 10:
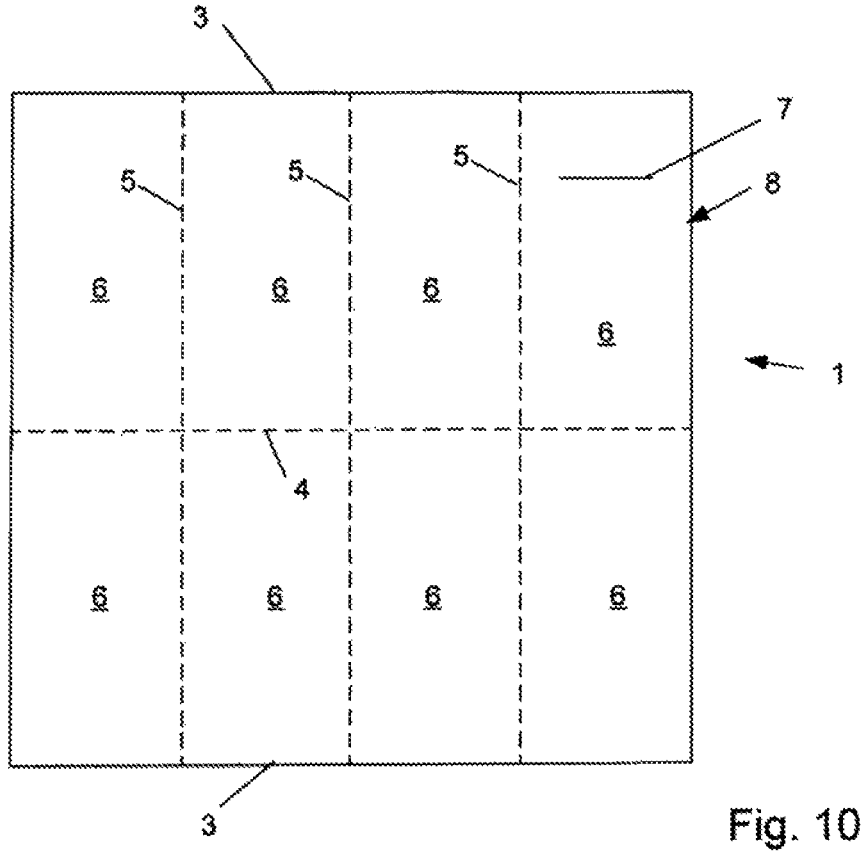
FIG. 10: shows a development of a sixth exemplary embodiment of the napkin.
Figure 11:
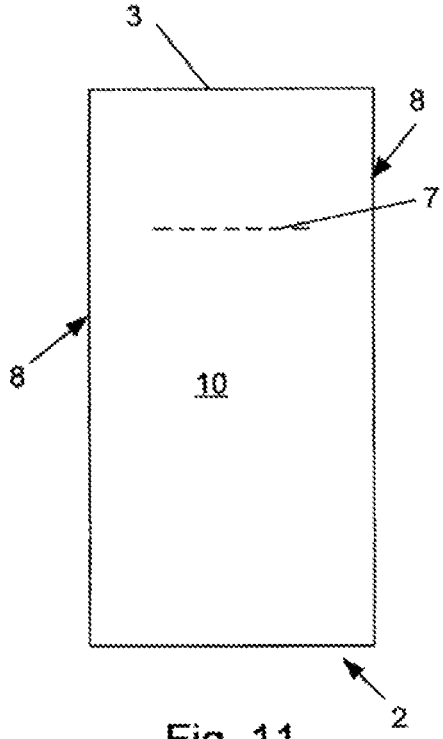
FIG. 11: is a plan view onto the napkin of FIG. 10 in the folded state.

Pursuant to FIG. 10, one slit 7 is provided in the upper fourth of the field 6 in the upper right hand position. Pursuant to FIG. 11, the sheet 1 is folded to form the rectangular envelope 10, which completely covers the field 6 that is provided with the slit 7.

The specification incorporates by reference the disclosure of German application 10 2007 033 572.7 filed Jul. 19, 2007, as well as International application PCT/DE2008/001026, filed Jun. 14, 2008.

The present invention is, of course, in no way restricted to the specific disclosure of the specification and drawings, but also encompasses any modifications within the scope of the appended claims.

The invention claimed is:

1. A napkin comprising:

a square sheet (1) folded multiple times along at least one fold line to form a basic rectangular shape (2);

three knife edge slits (7) configured for receiving and holding at least a portion of a piece of cutlery, wherein said knife edge slits comprise an uppermost slit, a middle slit, and a lowermost slit, wherein as arranged in the longitudinal direction of said basic rectangular shape (2), said uppermost slit is disposed in an upper fourth portion, said lowermost slit is disposed in a lower eighth portion, and said middle slit is disposed centrally between said upper fourth and lower eighth portions, wherein said slits (7) are disposed parallel to one another, wherein each of said slits (7) extends parallel to one narrow side of said basic rectangular shape (2) and each of said slits (7) is spaced from two long sides (8) of said basic rectangular shape (2) and from at least one outer edge (3) of said sheet, and wherein said slits (7) are formed as cuts through said sheet that separate a material from which said sheet is made without cutting out and removal of the material.

2. A napkin according to claim 1, wherein one of said slits (7) is longer than the one or two other slits (7).

3. A napkin according to claim 1, wherein said square sheet (1) is provided with a first fold line (4) that is disposed centrally as well as parallel to oppositely disposed outer edges (3) of said sheet (1), and wherein second fold lines (5) having respectively opposing folding directions are provided that extend perpendicular to said first fold line (4), and equidistantly relative to one another, to divide said sheet (1) into a four by two matrix having fields (6) of the same size in said basic rectangular shape (2).

4. A napkin according to claim 1, wherein at least one corner of a square form, which results from a folding of said square sheet (1) twice, is folded.

5. A napkin according to claim 3, wherein said slits (7) are disposed either in a field (6) disposed along an edge or are disposed in a central field (6).

6. A napkin according to claim 5, wherein said slits (7) are disposed in a central field (6), and wherein an outer rectangle covers at least portions of said field (6) that is provided with said slits (7).

* * * * *